US006945015B2

(12) United States Patent
Ours et al.

(10) Patent No.: US 6,945,015 B2
(45) Date of Patent: Sep. 20, 2005

(54) SHRINK WRAP TRANSPORTABLE CONTAINER AND METHOD

(75) Inventors: David C. Ours, Marshall, MI (US); Randall L. Cary, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 10/732,594

(22) Filed: Dec. 10, 2003

(65) Prior Publication Data

US 2005/0126126 A1 Jun. 16, 2005

(51) Int. Cl.[7] ..... B65B 53/02; B65B 57/00; B67B 3/26

(52) U.S. Cl. ..... 53/442; 53/479; 53/75

(58) Field of Search ..... 53/442, 452, 467, 53/477, 479, 52, 75

(56) References Cited

U.S. PATENT DOCUMENTS

| | | | |
|---|---|---|---|
| 2,765,816 | A | 10/1956 | Carter |
| 3,374,599 | A | 3/1968 | Sanders |
| 3,570,749 | A | 3/1971 | Sato et al. |
| 3,778,962 | A | 12/1973 | James |
| 3,785,410 | A | 1/1974 | Carter |
| 3,906,591 | A | 9/1975 | Boiardi |
| 3,928,940 | A | 12/1975 | Fagniart |
| 3,943,988 | A | 3/1976 | Consorti |
| 3,968,626 | A | 7/1976 | Hobbs |
| 4,074,507 | A | 2/1978 | Ruf et al. |
| 4,101,292 | A | 7/1978 | Hogan, II |
| 4,113,146 | A | 9/1978 | Williamson |
| 4,136,501 | A | 1/1979 | Connolly |
| 4,219,054 | A | 8/1980 | Carter et al. |
| 4,223,061 | A | 9/1980 | Michaels |
| 4,249,839 | A | 2/1981 | Vance |
| 4,253,507 | A | 3/1981 | Williamson |
| 4,299,076 | A | 11/1981 | Humphrey |
| 4,339,040 | A | 7/1982 | Peil et al. |
| 4,360,996 | A | 11/1982 | Rutter |
| 4,500,001 | A | 2/1985 | Daniels |
| 4,546,593 | A | 10/1985 | Lasscock |
| 4,648,432 | A | 3/1987 | Mechalas |
| 4,706,441 | A | 11/1987 | Chervalier |
| 4,734,292 | A | 3/1988 | Gerardus Van Boxtel |
| 4,753,060 | A | 6/1988 | Furukawa |
| 4,781,475 | A | 11/1988 | LaFleur |
| 5,025,925 | A | 6/1991 | Wiklund |
| 5,353,936 | A | 10/1994 | Dockstader et al. |
| 5,354,569 | A | 10/1994 | Brown et al. |
| 5,507,859 | A | 4/1996 | Kaiser |
| 5,544,472 | A | 8/1996 | Koskinen et al. |
| 5,566,530 | A | 10/1996 | Johnstone et al. |
| 5,567,048 | A | 10/1996 | Hammonds |
| 5,573,044 | A | 11/1996 | Mechalas |
| 5,598,684 | A | 2/1997 | Aarts |
| 5,678,387 | A | 10/1997 | Aarts |
| 5,787,945 | A | 8/1998 | Riemersma |
| 5,809,744 | A | 9/1998 | Villines et al. |
| 5,887,409 | A | 3/1999 | Leal Pereira Da Silva |
| 5,967,579 | A | 10/1999 | Hebert |
| 6,012,266 | A | 1/2000 | Koskinen et al. |
| 6,131,766 | A | 10/2000 | King et al. |
| 6,205,750 | B1 | 3/2001 | Koskinen et al. |
| 6,324,818 | B1 | 12/2001 | Morness et al. |
| 6,343,459 | B1 | 2/2002 | Seaward et al. |
| 6,494,324 | B2 | 12/2002 | Ours et al. |
| 2001/0008567 | A1 | 7/2001 | Burkhardt |
| 2002/0191869 | A1 | 12/2002 | Stewart et al. |

*Primary Examiner*—John Paradiso
(74) *Attorney, Agent, or Firm*—Howard & Howard

(57) ABSTRACT

The invention provides a diameter reducing system for reducing the diameter of a flexible container as the container is filled. The system includes a shrinking device to shrink the container at the fill level as the container is filled with a plurality of particles. The shrinking device can include a heater to direct heat at the fill level. The container can be a bag formed from heat shrinkable material. Shrinking of the container at the fill level as the container fills promotes supporting engagement between particles.

18 Claims, 3 Drawing Sheets

SHRINK WRAP TRANSPORTABLE CONTAINER AND METHOD

BACKGROUND OF THE INVENTION

1. Field of the Invention

The invention relates to a container configured to hold a plurality of articles, and, more particularly, to a radially flexible container with means to hold the contents so that a blow or acceleration will not damage the contents.

2. Description of the Related Art

Articles can be contained and transported in flexible containers such as bags. It can be desirable to limit the movement of individual articles in the flexible container with respect to one another to reduce the likelihood that articles will be damaged and to increase the likelihood that the container will maintain a relatively rigid shape. Several different methods have been proposed to limit the movement of individual articles in the flexible container with respect to one another. For example, it is known to fill a flexible container and shrink-wrap the filled container. It is known to draw air from the flexible container to define a vacuum, wherein the vacuum seal can substantially limit the movement of articles in the container with respect to one another. It also is known to compress a filled, flexible container with pressurized air to urge air from the flexible container and substantially limit movement of articles in the container with respect to one another.

The present inventors previously made invention of a Transportable Container for Bulk Goods and Method for Forming the Container, U.S. Pat. No. 6,494,324. A radially flexible container is filled with a filling system and the diameter of the container is reduced at the fill level as the fill level rises.

SUMMARY OF THE INVENTION AND ADVANTAGES

The subject invention provides an improvement over the prior diameter reducing system wherein the container is shrunk at the fill level by heat shrinking. A heater can be positioned adjacent the fill level to direct heat at the container to shrink the container at the fill level. A large diameter of the container receives particles and the container is shrunk at the fill level to a smaller fill diameter. Shrinkage of the container generates hoop forces and promotes controllable contact between particles.

Accordingly, the subject invention provides an alternative to stretch wrap to reduce the diameter of the container. The amount of material required to package particles is reduced by the elimination of stretch wrap. The amount of waste material from used packaging material is reduced by the elimination of stretch wrap.

Other applications of the present invention will become apparent to those skilled in the art when the following description of the best mode contemplated for practicing the invention is read in conjunction with the accompanying drawings.

DETAILED DESCRIPTION OF A PREFERRED EMBODIMENT

Throughout the present specification and claims the phrase fill material is used as a shorthand version of the wide range of products that can be packaged utilizing the present invention. The terms fill material, articles, and particles can be used interchangeably. The present invention finds utilization in packaging any material that is packaged. These items can encompass large bulk packaged pieces as well as very small bulk packaged pieces. Examples of smaller fill materials include, but are not limited to, the following: agricultural products like seeds, rice, grains, vegetables, fruits; chemical products like fine chemicals, pharmaceuticals, raw chemicals, fertilizers; plastics like plastic resin pellets, plastic parts, rejected plastic parts, machined plastic parts; cereals and cereal products such as wheat; a variety of machined parts of all sorts; wood products like wood chips, landscaping material, peat moss, dirt, sand, gravel, rocks and cement. The present invention also finds utilization in bulk packaging of larger fill material including, but not limited to: prepared foods; partially processed foods like frozen fish, frozen chicken, other frozen meats and meat products; manufactured items like textiles, clothing, footwear; toys like plastic toys, plastic half parts, metallic parts, soft toys, stuffed animals, and other toys and toy products. All of these types of materials and similar bulk packaged materials are intended to be encompassed in the present specification and claims by this phrase.

The present invention can be applied in combination with any of the features disclosed in U.S. Pat. No. 6,494,324, which is hereby incorporated by reference in its entirety. Some of the features disclosed in U.S. Pat. No. 6,494,324 that can be applied in combination with present invention are described briefly below.

Figure 1:
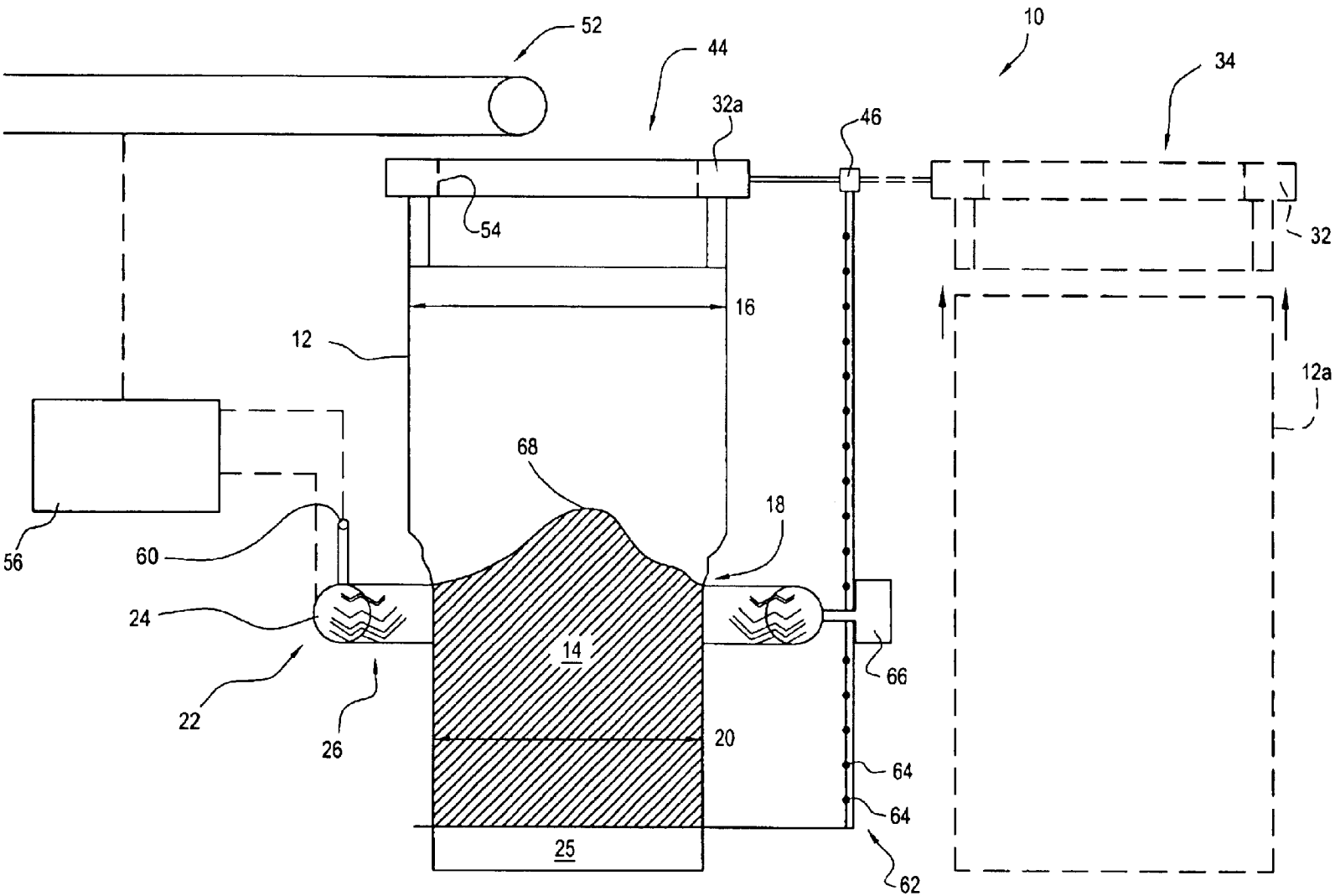
FIG. 1 is a schematic side view of a first embodiment of the diameter reducing system according to the invention.

Referring now to FIG. 1, the present invention provides method and apparatus 10 for filling a container 12 with a plurality of particles 14 comprising the steps of filling the radially flexible container 12 through a large diameter 16 with the plurality of particles 14 to a fill level 18 and reducing the large diameter 16 of the radially flexible container 12 to a smaller fill diameter 20 substantially at the fill level 18 as the fill level 18 rises during filling of the flexible container 12. The large diameter 16 is reduced by shrinking the flexible container 12 substantially at the fill level 18. The apparatus provided by the invention includes a shrinking device 22 to shrink the large diameter 16. The shrinking device 22 can include a heater 24 to direct heat 26 at container 12 adjacent the fill level 18 to shrink the large diameter 16 to the fill diameter 20. Preferably, the shrinking device 22 is kept within plus or minus twelve inches of the fill level 18.

The reduction of the large diameter 16 at the fill level 18 by shrinking the container 12 at the fill level 18 generates hoop forces which apply a gentle squeeze to the fill material 14, helping to support and firm it. The hoop forces stabilize the fill material 14 by promoting controllable contact between the elements of the fill material 14 being loaded into container 12, thereby promoting bridging between the components of the fill material 14. For example, when the fill material 14 being loaded is a bulk cereal in puff or flake form, hoop forces promote bridging between cereal pieces, thereby reducing the relative motion between the pieces and immobilizing the cereal within container 12. By adjusting the extent of shrinkage, hoop forces can be tailored to the type of fill material 14 being inserted in container 12. Hoop forces allow for a very compact and rigid container, which does not allow the fill material 14 to shift or get crushed within container 12. The container 12 is filled without any internal frame or support means, since the subsequent removal of such a frame or support means would result in the hoop forces being dissipated and also cause dislodging of the fill material 14 which may result in some of the fill material 14 being crushed.

Figure 2:
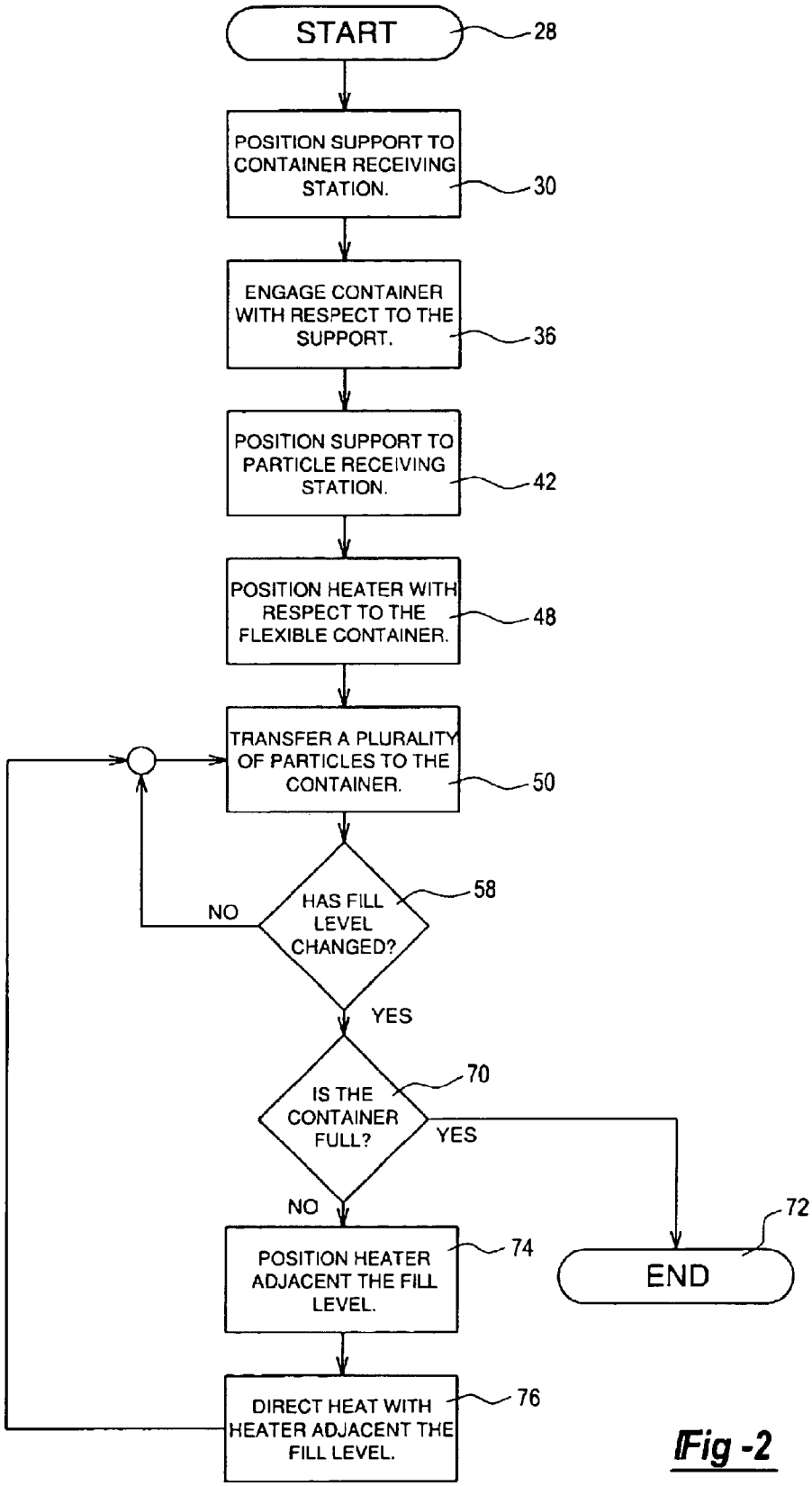
FIG. 2 is a simplified flow diagram illustrating the steps performed by an embodiment of the present invention.
Figure 3:
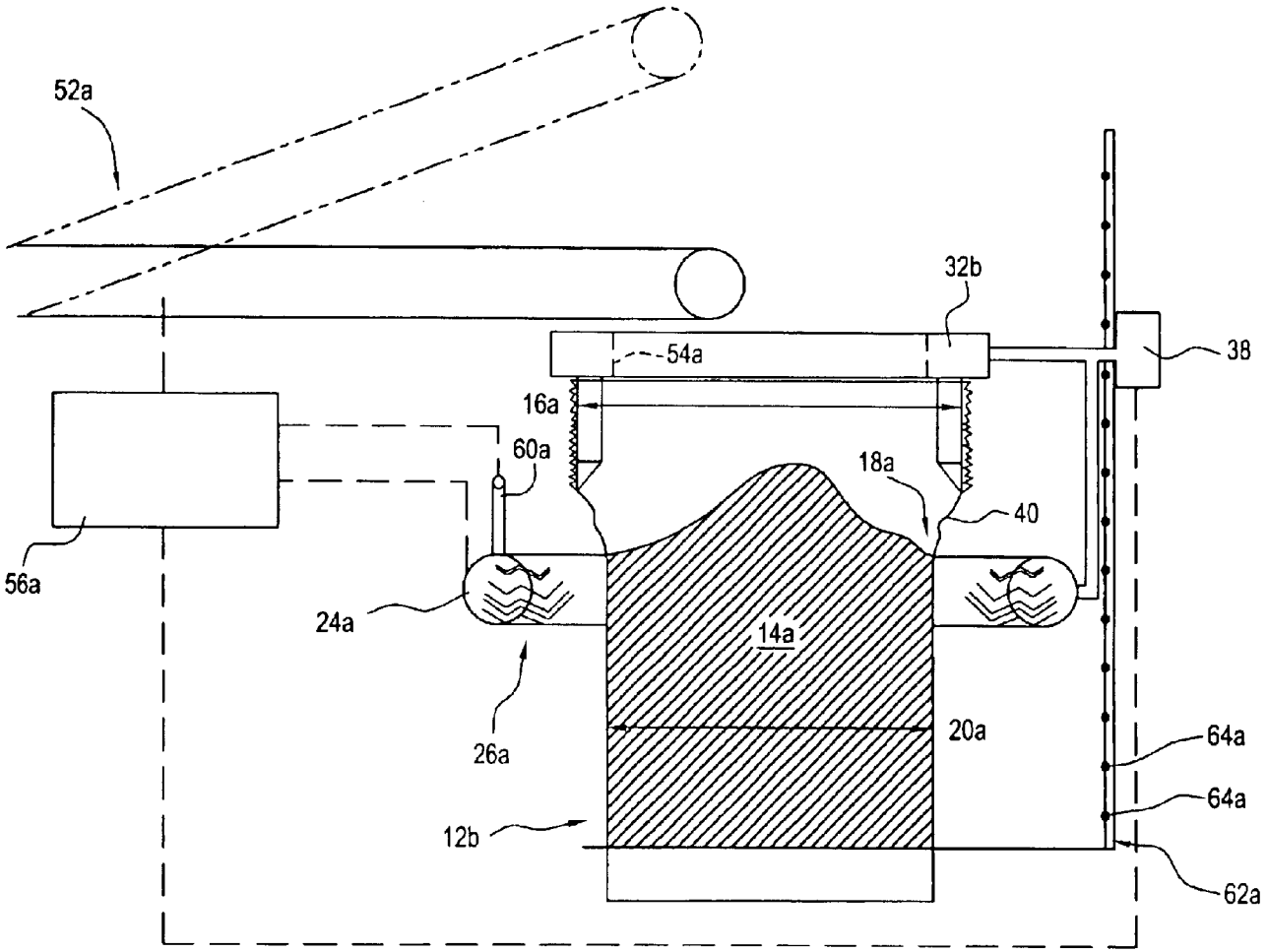
FIG. 3 is a schematic side view of a second embodiment of the diameter reducing system according to the invention.

A process performable by an embodiment of the present invention is illustrated in the simplified flow diagram of FIG. 2 and the schematic side views of FIGS. 1 and 3. The process begins at step 28. At step 30, a support 32 can be positioned at a container receiving station 34 (shown in phantom in FIG. 1). At step 36, a container 12*a* can be engaged with respect to the support 32. As shown in FIG. 1, the container 12 can be suspended from the support 32*a* as the container 12 is filled. As shown in FIG. 3, the flexible container 12*b* can be supported by the support 32*b* in a bunched orientation during filling. The flexible container 12*b* can be incrementally released from the bunched orientation. For example, as the fill level 18*a* changes, the support 32*b* can be vertically moved with a motor 38. Movement of the support 32*b* and the weight of the particles 14*a* can cooperate to release a length 40 of the flexible container 12*b* for receiving additional particles 14*a*.

After step 36, the process continues to step 42 and the support 52 is positioned at a particle receiving station 44. The support 32*a* can be moved between the container receiving station 34 and the particle receiving station 44 with a motor 46. The motor 38, shown in FIG. 3, can also be operable to move the support 32*b* between container receiving and particle receiving stations.

The process continues to step 48 and the heater 24 can be positioned with respect to the flexible container 12. The heater 24 can be complementarily shaped with respect to the flexible container 12. For example, the container 12 can be cylindrical and the heater 24 can be a ring for receiving the flexible container 12. The heater 24 can encircle the fill level 18.

The process continues at step 50 and a plurality of particles 14 can be transferred to the container 12. The particles 14 can be transferred to the container 12 with a filling system including a conveyor 52. The particles 14 move along the conveyor 52 and can drop through a passage 54 defined by the support 32*a*. A controller 56 can control the conveyor 52 to move particles 14 to the container 12. As shown in FIG. 3, the filling system can include an articulating conveyor 52*a*. The controller 56 can control the filling rate of the container 12.

Step 58 monitors whether the fill level 18 has changed. The fill level 18 can be sensed by a sensor 60. The sensor 60 can be an infrared sensor. The invention can include an infrared sensor emitter array 62 supporting a plurality of infrared emitters 64 along on a path extending parallel to the vertical axis of the container 12. Each emitter 64 can emit infrared radiation substantially traverse with respect to the vertical axis of the container 12. The sensor 60 can be horizontally aligned with at least one of the plurality of infrared emitters 64 during filling of the container 12. When the fill level changes, infrared radiation communicated between the emitter 64 and the sensor 60 can be blocked by the particles 14. In response to a change in the fill level, the sensor 60 can emit a signal to the controller 56. The controller 56 can control a motor 66 to vertically move the sensor 60 so that the sensor 60 can receive infrared radiation from one of the plurality of emitters 64. To enhance the clarity of FIG. 1, the schematic line between the controller 56 and the motors 46, 66 representing communication between the controller 56 and the motors 46, 66 is not shown but exists. The sensor 60 can be immovably associated with respect to the heater 24 such that the motor 66 moves the sensor 60 and the heater 24 concurrently. Alternatively, the sensor 60 can include a sonic probe and sense the fill level 18 with sound waves, or can include an infrared detector, or can include a scale sensing the weight of the particles 14 disposed in the container 12.

In alternative embodiments of the invention, the sensor 60 can include an ultrasonic transmitter and receiver, applying sound waves to monitor the fill level 18 of the material 14 in the container 12. In another embodiment, a lower support member, such as support member 25 shown in FIG. 1, for supporting the flexible container 12 includes a scale and the shrinking of the container 12 is coordinated with the measured weight of the fill material 14 thus allowing the shrinking device 22 to be maintained substantially at the fill level 18. In other embodiments, the system includes a timing mechanism that coordinates the movement of the shrinking device 22 based on the known fill rate of container 12.

For certain types of fill material 14 it can be advantageous to settle the fill material 14 as the flexible container 12 is being filled. To accomplish this, the support member 25 can include a vibratory shaker thereby permitting the support member 25 to settle the fill material 14 as the container 12 is being filled.

In alternative embodiments of the invention, the support member 25 is vertically movable. In such embodiments, during the initial stages of filling the container 12, the support member 25 is placed at a position very close to the conveyor 70. As the container 12 fills, the support member 25 is moved away from the conveyor 70, in a downward direction, to accommodate the accumulation of fill material 14 in the container 12. The advantage of this system is that fragile materials have a shorter distance to drop from the conveyor 70 into the container 12. Movement of the support member 25 can be accomplished by any of a variety of mechanisms including scissors platform legs, hydraulic pistons, pneumatic pistons, or a geared mechanism.

As used herein, the fill level is the highest level at which particles substantially occupy an entire cross sectional area of the container 12. The plurality of particles can define a crest 68 and the fill level 18 can be below the crest 68. The fill level can be twelve inches from the crest 68. Communication between the sensor 60 and a corresponding emitter 64 can be blocked by the crest 68. The sensor 60 can be spaced from the heater 24 a distance substantially similar to the distance between the crest 68 and the fill level 18.

If the fill level has not changed in step 58, the process returns to step 50 and a plurality of particles are transferred to the container 12. If the fill level has changed, the process continues to step 70 and the extent of filling of the container 12 is monitored. If the container 12 is full, the process ends at step 72. If the container 12 is not full, the process continues to step 74 and the heater 24 is positioned adjacent the fill level 18. The heater 24 can be moved along the container 12 with the motor 66. The motor 66 can move along a path extending substantially parallel to the vertical axis of the container 12.

Alternatively, as shown in FIG. 3, the support 32*b* can be moved in response to a change in the fill level. The support 32*b* can support the container 12*b* in a bunched orientation and can release the length 40 during vertical movement. The support 32*b* and a heater 24*a* can be immovably associated with respect to one another and can be vertically moved with the motor 38. The support 32*b* and heater 24*a* can be spaced from one another to reduce the likelihood that heat 26*a* will be directed to portion of the container 12*b* supported by the support 32*b* in the bunched orientation. A controller 56*a* can control the heater 24*a* to emit heat 26*a* and shrink the large diameter 16*a* to the fill diameter 20*a*.

After the heater 24 is positioned adjacent the fill level 18 at step 74, heat 26 can be directed adjacent the fill level 18 at step 76. Heat 26 can be directed to the fill level 18 to shrink the large diameter 16 of the container 12 to the fill diameter 20 at the fill level 18. The controller 56 can control the heater 24 to continuously emit heat 26 or selectively emit heat 26. The heater 24 can be selectively controlled to control the amount of heat 26 directed to the fill level 18. The amount of heat 26 can be controlled to control the extent or degree of shrinkage of the container 12. Shrinkage of the container 12 can generate hoop forces to stabilize the plurality of particles 14 and promote controllable contact between the individual particles. In a preferred embodiment, the hoop forces generated are approximately 1–3 lbs. per square inch. Shrinkage of the container 12 can be relatively gentle to bring individual particles into engagement with respect to one another. At any particular cross-section, the engaged particles can form a lattice reducing the likelihood of movement of the particles relative to one another and enhancing the structural rigidity of the container 12. Engagement between particles resulting from the application of hoop force at the fill level as the fill level rises can also reduce the likelihood that a blow or acceleration will damage the particles. After heat 26 is directed adjacent the fill level 18 at step 78, the process continues to step 50 and a plurality of particles 14 are transferred to the container 12.

Referring now to FIG. 3, in operation the controller 56*a* can control the conveyor 52*a* to fill the container 12*b* with particles 14*a*. In particular, the controller 56*a* can move the articulating conveyor 52*a* to a downward position and control the conveyor 52*a* to move particles through a passage 54*a*. The support 32*b*, the heater 24*a* and a sensor 60*a* can be immovably associated with respect to one another and be positioned below the articulating conveyor 52*a*. The container 12*b* can be supported in a bunched orientation by the support 32*b*. The articulating conveyor 52*a* can move a plurality of particles 14*a* to be received in the container 12*b*. The sensor 60*a* can receive infrared radiation from one of a plurality of emitters 64*a* disposed along the array 62*a*. When the fill level 18*a* rises and the sensor 60*a* is blocked from receiving infrared radiation from a corresponding emitter 64*a*, the sensor 60*a* can emit a signal corresponding to a change in the fill level to the controller 56*a*. In response, the controller 56*a* can control the motor 38 to move the support 32*b* vertically upward. The controller 56*a* can also control the articulating conveyor 52*a* to move upwardly to prevent the support 32*b* from contacting the articulating conveyor 52*a*. When the support 32*b* moves upwardly, a length 40 of the container 12*b* is released from the bunched orientation. The controller 56*a* can control the heater 24*a* to emit heat 26*a* when the support 32*b* is moved upwardly. Alternatively, the controller 56*a* can control the heater 24*a* to emit heat 26*a* substantially continuously.

The top of the container 12 can be closed or left open after filling depending on the fill material. For example, certain fill material 14 such as wood chips, sand, gravel, and other fill material 14, may not require that the open top be closed. The open top can be closed in any of a variety of manners known in the art including, but not limited to: sonic or heat welding of open top, closure of open top with a plastic pull tie, closure of open top with wire or rope, closure of open top with a clamp, and other closure means known in the art. In embodiments where continuous tubular rolls and sonic or heat welding of the open top are used, the process of sealing the top of one container 12 can also create the bottom of the next container 12.

It may be advantageous that once the container 12 has been filled with fill material 14 to include the additional step of placing a nylon strap netting over the container 12. The netting may include a series of loops either at the top or the bottom of the netting to enable the resulting load to handle like a Super Sack®. Moving the unit with the loops rather than the pallet or bottom support would be advantageous in loading cargo ships with a very stable load with the least amount of cost associated with packaging material.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method for filling a container with a plurality of particles comprising the steps of filling a radially flexible container through a large diameter with the plurality of particles to a fill level, reducing the large diameter of the radially flexible container to a smaller fill diameter substantially at the fill level as the fill level rises during filling of the flexible container, wherein the reducing step is characterized by:

shrinking the flexible container substantially at the fill level.

2. The method of claim 1 wherein said shrinking step is further defined as directing heat at the flexible container adjacent the fill level to reduce the large diameter to the fill diameter.

3. The method of claim 2 including controlling a quantity of heat directed at the flexible container to control a rate of shrinkage of the flexible container.

4. The method of claim 2 including surrounding the fill level with heat to shrink the large diameter to the smaller fill diameter.

5. The method of claim 2 including sensing the fill level as the fill level rises during filling of the flexible container.

6. The method of claim 5 including moving one of the flexible container and the directed heat with respect to the other in response to the sensed fill level.

7. The method of claim 5 including supporting the flexible container in a bunched orientation during filling of the flexible container.

8. The method of claim 7 including incrementally releasing a length of the flexible container from the bunched orientation in response to the sensed fill level.

9. The method of claim 5 including suspending the flexible container as the flexible container is filled.

10. The method of claim 9 wherein said suspending step includes moving the directed heat to the fill level.

11. An apparatus for filling a container with a plurality of particles wherein a filling system fills a radially flexible container through a large diameter with the plurality of particles to a fill level, and a diameter reducing system reduces the large diameter of the radially flexible container to a smaller fill diameter substantially at the fill level as the fill level rises dining filling of the flexible container, wherein the diameter reducing system is characterized by:

a shrinking device to shrink the flexible container substantially at the fill level.

12. The apparatus of claim 11 wherein said shrinking device includes a heater to direct heat at the flexible container to shrink the large diameter to the fill diameter.

13. The apparatus of claim 12 wherein said heater is complementarily shaped with respect to the flexible container.

14. The apparatus of claim 12 wherein said shrinking device includes at least one sensor for sensing the fill level as the fill level rises during filling of the flexible container.

15. The apparatus of claim 14 including a first support for supporting the flexible container in a bunched orientation prior to filling of the flexible container.

16. The apparatus of claim 14 including a second support for suspending the flexible container as the flexible container is filled.

17. The apparatus of claim 11 wherein said particulate material is one of cereal, ready-to-eat cereal, agricultural products, seeds, rice, grains, vegetables fruits, chemicals, pharmaceuticals, fertilizers, plastic resin pellets, plastic parts, wood chips, landscaping material, peat moss, dirt, sand, gravel, rocks, cement, prepared foods, partially processed foods, frozen fish, frozen chicken, textiles, clothing, footwear, and toys.

18. The apparatus of claim 11 including means to close a top of the container, wherein closing means is selected from the group consisting of a sonic welder, a heat welder, a plastic pull tie, a wire, a rope, and a clamp.

* * * * *